United States Patent [19]

Kazuo

[11] 4,094,134

[45] June 13, 1978

[54] THREAD END CUTTING APPARATUS IN SPINNING MACHINE

[75] Inventor: Nakanishi Kazuo, Ujishi, Japan

[73] Assignee: Murata of America Inc., Charlotte, N.C.

[21] Appl. No.: 686,398

[22] Filed: May 14, 1976

[51] Int. Cl.[2] ..... D01H 11/00

[52] U.S. Cl. ..... 57/56; 57/34.5

[58] Field of Search ..... 57/34.5, 34 R, 54, 56, 57/156

[56] References Cited

U.S. PATENT DOCUMENTS

| | | | |
|---|---|---|---|
| 3,263,407 | 8/1966 | Jones, Sr. | 57/56 X |
| 3,312,051 | 4/1967 | Schumann et al. | 57/34.5 |
| 3,426,518 | 2/1969 | Winter et al. | 57/54 X |
| 3,782,094 | 1/1974 | Flowers et al. | 57/34.5 |

*Primary Examiner*—John Petrakes

*Attorney, Agent, or Firm*—Whittemore, Hulbert & Belknap

[57] ABSTRACT

An apparatus for cutting short the leading end of the thread to be wound on a bobbin in a spinning machine, whereby after the thread is wound up on a bobbin with the leading end of the thread being gripped between the spindle and the bobbin and the thread has been wound up on the bobbin, the leading end of the thread is cut at the bobbin end by the cutting member of a cutter device which travels in front of a row of spindles of a spinning machine.

1 Claim, 6 Drawing Figures

THREAD END CUTTING APPARATUS IN SPINNING MACHINE

BACKGROUND OF THE INVENTION

The invention relates to fine spinning machines and refers more specifically to an apparatus for and a method of cutting short the leading end of thread wound on a bobbin in a fine spinning machine to prevent tangling of the leading and trailing ends of thread wound on the bobbin.

SUMMARY OF THE INVENTION

The present invention relates to thread end cutting apparatus in a spinning machine, and refers more particularly to apparatus for cutting short the leading end of the thread wound up on the bobbin set on the spindle of a spinning machine.

The primary object of the present invention is to provide a device for cutting short the leading end of thread close to the cop so as to eliminate any risk of entanglement of the leading and trailing ends of wound thread to thereby get rid of any impediment in the ensuing step. According to the present invention, the work for drawing out the trailing end alone of the thread in the ensuing step is extremely simplified.

PREFERRED EMBODIMENT OF THE INVENTION

Figure 1:
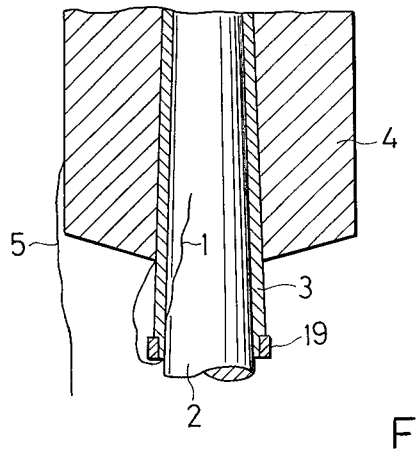
FIG. 1 is a partial sectional view showing the positions of the leading end and trailing end of thread when a bobbin is set in position on a spindle.
Figure 2:
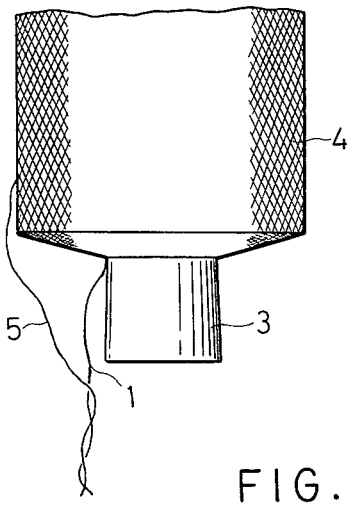
FIG. 2 PRIOR ART
FIG. 2 is a partial side elevational view of the bobbin conventionally removed from the spindle without use of a cutter device according to the present invention.

Generally, when setting a paper tube in position on the spindle of a fine spinning machine, the leading end 1 of the thread to be wound is gripped and fixed between the spindle 2 and the bobbin 3 simultaneously with the setting of the paper tube, and then the spindle 2 rotated to gradually wind up the thread on the bobbin 3 to form a yarn layer 4 as shown in FIG. 1. In such spinning machines, however, when the full bobbin 3 is removed from the spindle 2, the leading thread end 1 which has been gripped between said spindle 2 and bobbin 3 would be freed to hang down and might twine itself round the trailing end 5 of the wound thread as shown in FIG. 2. Such entanglement of the leading and trailing ends 1 and 5 of the thread proves to be a serious impediment to the operation in the ensuing step where the trailing end alone of the thread is taken out and the bobbins are supplied to the winder by using an automatic cop feeder.

Figure 4:
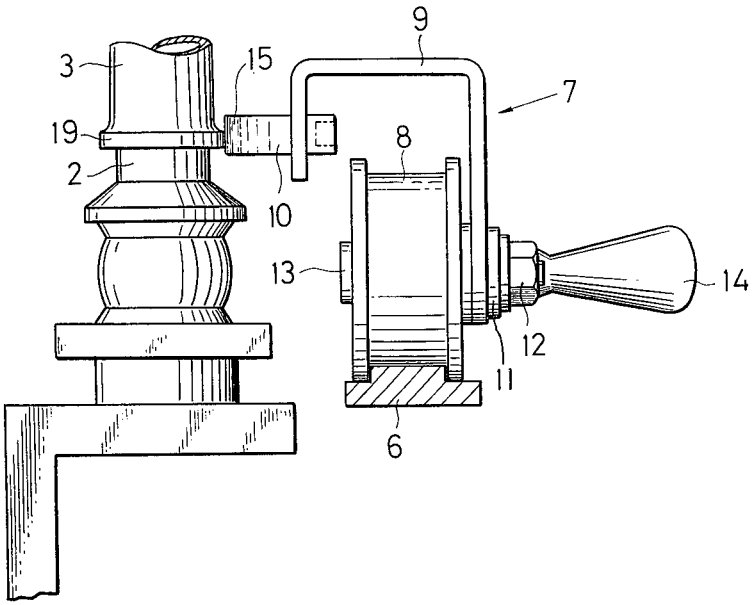
FIG. 4 is a side elevational view of an apparatus according to the present invention.
Figure 5:
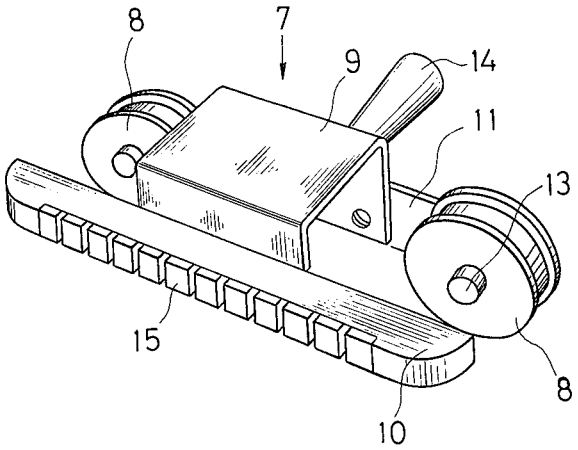
FIG. 5 is a perspective view of one embodiment of a cutter device according to the present invention.

Referring to FIG. 4, it will be seen that a bar 6 is fixedly provided parallel to a row of spindles 2, and rollers 8 of a cutter device 7 such as depicted in FIG. 5 are mounted on the bar. The cutter device 7 comprises rotatable rollers 8, a body portion 9 and a cutting member 10. Each of said rollers 8 is rotatably mounted on a shaft 13 secured by a screw 12 to a support arm 11 which, in turn, is secured to the body portion 9. The cutting member 10 is also secured to said body portion 9. The cutter device can travel on the bar 6 provided parallel to and in front of a row of spindles 2. The operator can move the cutter device manually by operating a handle 14 mounted to the body portion 9 of the device, but no such handle 14 is necessary when driving the cutter device by a motor provided in the body portion 9.

Figure 6:
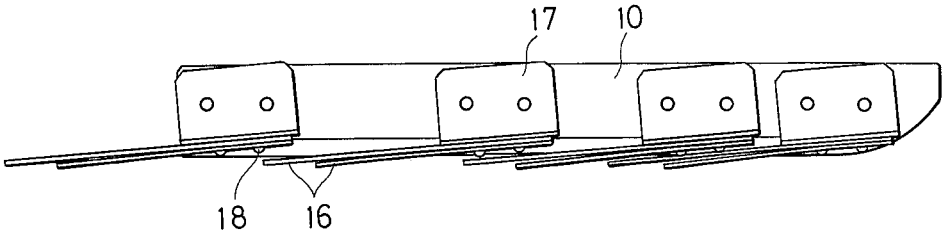
FIG. 6 is a plane view showing another embodiment of the cutter device according to the present invention.

The cutting member 10 is provided with cutting edges 15. In the second embodiment of the cutting member 10 shown in FIG. 6, a plurality of leaf springs 16 terminating into cutting edges at the free ends are secured by screws 18 to the respective L-shaped attachments 17. In this second embodiment, the attachments 17 must be changed in accordance with the direction of rotation of the spindle, but the cutting edges 15 of the cutter member shown in FIG. 5 have an advantage that they can be used regardless of the direction of rotation of the spindle.

Figure 3:
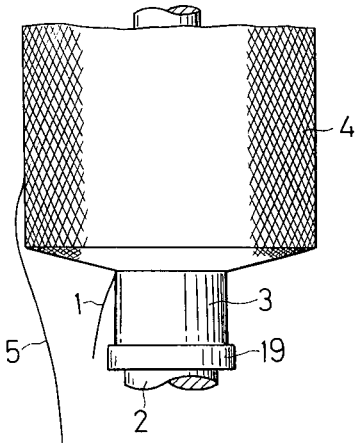
FIG. 3 is a partial side elevational view of the bobbin removed from the spindle after use of a cutter device according to the present invention.

A bobbin 3 is set in position on each spindle 2 shown in FIG. 4. The bobbin or spool may be made of paper, wood or synthetic resin, but it is desirable to attach a metal fitting 19 to the lower end of the bobbin where the cutter device contacts. As described above, bar 6 is fixedly provided parallel to and in front of a row of spindles 2, but the position of said bar 6 is selected such that the cutting edges 15 of the cutting member 10 fixed to the body portion 9 of the cutter device 7 will just touch the metal fittings 19 provided at the lower ends of the bobbins 3 set on the respective spindles 2. Said bar 6 may be a round rod. Under this condition, winding of thread on the bobbins in the spinning machine is completed to present a condition such as shown in FIG. 7, and while the bobbins are still rotating with the associated spindles, the operator operates the handle 14 to move the cutter device on the bar 6, whereby the leading ends of threads gripped between the respective bobbins and spindles are held by the metal fittings 19 at the lower ends of the bobbins and the cutting edges 15 of the cutter member 10 and thereby cut successively. As a result, the leading end 1 of thread extending out slightly from the cop 4 is cut and only a short length of the leading end 1 of thread is remaining as shown in FIG. 3, thereby eliminating any risk of entanglement of the leading end 1 of thread with its trailing end 5.

What is claimed is:

1. A thread end cutting apparatus in combination with a fine spinning machine, which fine spinning machine includes a row of rotatable spindles and in combination with a separate bobbin mounted on each of the respective spindles having an annular metal fitting on one end thereof and wherein the leading end of thread to be wound on a bobbin on rotation of the associated spindle is placed between the bobbin and spindle as the bobbin is sleeved over the spindle and wherein the leading end of the thread so placed between a bobbin and spindle is passed over the metal fitting prior to being wound on the bobbin, which cutting apparatus includes a guide bar positioned adjacent the row of spindles and parallel thereto and a cutter device mounted on the guide bar for movement therealong parallel to the row of spindles, which cutter device includes a support arm extending longitudinally of the bar, a roller adjacent each end of the support arm, shafts rotatably mounting the rollers, each roller having a peripheral configuration whereby the roller is guided along the bar on engagement of the roller with the bar and movement of the cutting device longitudinally of the bar, screw means securing the shafts to the support arm at the opposite ends thereof, a U-shaped body portion having a pair of leg portions with free ends and a connecting portion, the free end of one of the leg portions of which is secured to the support arm, a cutting member secured to the free end of the other leg portion of the U-shaped body portion, said cutting member including a plurality of L-shaped attachments secured thereto in spaced apart relation longitudinally of the bar, a pair of leaf springs connected to each attachment providing cutting surfaces extending longitudinally of the bobbins in spaced apart relation longitudinally of the bar with the cutting device positioned on the bar for movement therealong, said cutting surfaces being adapted to resiliently engage the annular metal fittings on the bobbins on movement of the cutting device along the bar to engage and cut the leading end of the thread placed between the bobbin and spindle.

* * * * *